US006604583B1

(12) United States Patent
Van Randen

(10) Patent No.: US 6,604,583 B1
(45) Date of Patent: Aug. 12, 2003

(54) VIBRATING DEVICE AND A METHOD FOR DRIVING AN OBJECT BY VIBRATION

(75) Inventor: Johan Bernard Van Randen, Almere (NL)

(73) Assignee: International Construction Equipment B.V., Almere (NL)

( * ) Notice: Subject to any disclaimer, the term of this patent is extended or adjusted under 35 U.S.C. 154(b) by 0 days.

(21) Appl. No.: 09/646,487

(22) PCT Filed: Mar. 18, 1999

(86) PCT No.: PCT/NL99/00152

§ 371 (c)(1),
(2), (4) Date: Oct. 27, 2000

(87) PCT Pub. No.: WO99/47757

PCT Pub. Date: Sep. 23, 1999

(30) Foreign Application Priority Data

Mar. 19, 1998 (NL) ..... 1008635

(51) Int. Cl.[7] ..... E21B 7/24
(52) U.S. Cl. ..... 173/49; 173/1; 173/216
(58) Field of Search ..... 173/49, 1, 216; 475/220

(56) References Cited

U.S. PATENT DOCUMENTS 3,433,311 A * 3/1969 Lebelle ..... 173/49
3,564,932 A * 2/1971 Lebelle ..... 173/49
3,916,791 A * 11/1975 Simeth ..... 101/141
3,938,595 A * 2/1976 Swenson ..... 173/1
4,113,034 A * 9/1978 Carlson ..... 173/49
4,471,666 A 9/1984 Unrath et al. ..... 74/61
4,898,249 A * 2/1990 Ohmori ..... 173/176
5,102,378 A * 4/1992 Gobert ..... 475/231
5,177,386 A * 1/1993 Shimada ..... 310/81
5,253,542 A * 10/1993 Houze ..... 173/49
6,123,640 A * 9/2000 Schulz ..... 475/336
6,132,330 A * 10/2000 Leggett ..... 475/331
6,234,718 B1 * 5/2001 Moffitt et al. ..... 172/40

FOREIGN PATENT DOCUMENTS

| | | | |
|---|---|---|---|
| DE | 28 42 873 | 4/1980 | ..... E02D/3/06 |
| DE | 40 21 278 | 1/1992 | ..... B06B/1/16 |
| DE | 42 01 224 | 4/1993 | ..... E02D/3/074 |
| EP | 0 088 828 | 9/1983 | ..... E02D/3/074 |
| EP | 0 524 056 | 1/1993 | ..... B06B/1/16 |
| GB | 2 096 268 | 10/1982 | ..... B06B/1/16 |

* cited by examiner

*Primary Examiner*—Rinaldi I. Rada
*Assistant Examiner*—Louis Tran
(74) *Attorney, Agent, or Firm*—Moser, Patterson & Sheridan, L.L.P.

(57) ABSTRACT

A device for driving an object by vibration, in particular a pile or sheet piling to be driven into the ground be removed therefrom, which device comprises a first eccentrically rotatable weight (1, 2) and a second eccentrically rotatable weight (3, 4), which weights are interconnected by a phase shifter (13) which is capable of adjusting the rotational position of the weights (1, 2; 3, 4) relative to each other. The phase shifter (13) comprises a differential.

10 Claims, 3 Drawing Sheets

VIBRATING DEVICE AND A METHOD FOR DRIVING AN OBJECT BY VIBRATION

CROSS-REFERENCE TO RELATED APPLICATIONS

This application is the National Stage of International Application No. PCT/NL99/00152, filed Mar. 18, 1999, and published under PCT Article 21(2) in English, and claims priority to Netherlands Application No. 1008635, filed on Mar. 19, 1998. Each of the aforementioned related patent applications is herein incorporated by reference in its entirety.

BACKGROUND OF THE INVENTION

1. Field of the Invention

The invention relates to a device for driving an object by vibration, in particular a pile or sheet piling to be driven into the ground or be removed therefrom, which device comprises a first eccentrically rotatable weight and a second eccentrically rotatable weight, which weights are interconnected by a phase shifter which is capable of adjusting the rotational position of the weights relative to each other. Vibration can be produced by having an eccentrically rotatable weight, that is, a rotatable mass whose centre of gravity does not lie on the axis of rotation, rotate about its axis. If said vibration comprises sufficient energy, it is possible to set an object vibrating therewith so as to drive said object into the ground by vibration. Although the present description describes the driving into the ground of objects, the device can also be used for removing objects from the ground.

By providing the device with two eccentrically rotatable-weights, the degree of vibration as well as the direction or directions of the vibration can be influenced by changing the relative rotational position of the two eccentric weights when said weights vibrate at the same speed. Consequently, the device is provided with a so-called phase shifter, which is disposed in the mechanical transmission which connects the two eccentric weights and which is capable of changing the relative rotational position of the two weights.

2. Description of the Related Art

A device of this kind is known from EP-A-0524056, wherein the phase shifter comprises two gears which are coaxially rotatable about a shaft, which gears occupy a fixed position relative to each other during normal operation of the vibrating device, but wherein the rotational position of one gear relative to the rotational position of the other gear can be slightly changed. Since each of the gears is in drivable contact with an eccentrically rotatable weight, the relative rotational position of the two weights can be adjusted by changing the rotational position of the two gears.

The phase shifter which is disclosed in EP-A-0524056 comprises a part which is connected with one gear and a part which is connected with the second gear, which parts are in part disposed radially apart, thus forming an annular cylinder space. An annular piston is present within said cylinder space, which piston abuts against each of said parts with a helical camway. The relative rotational position of the two gears can be changed by axial movement of the piston, which movement can be effected by means of fluid pressure.

The object of the invention is to provide a device of the kind as described above which is provided with a phase shifter, wherein said phase shifter can be controlled in a simple and adequate manner, and wherein said, phase shifter is reliable and of simple construction.

In order to accomplish that objective, the device is provided with a phase shifter comprising a differential which is provided with three interconnected, rotatable parts, wherein rotation of one part results in rotation of another part or of both other parts, the first part of which differential is in drivable contact with the first rotatable weight, and the second part of which is in drivable contact with the second rotatable weight, and wherein the rotational position of the third part determines the relative rotational position of the two rotatable weights. Such a mechanical differential is by itself a tried and tested part, of which there are a number of known embodiments, which are capable of functioning in a satisfactory, efficient and reliable manner. It has become apparent that such a mechanical differential can be used in a surprisingly simple manner in a phase shifter for a vibrating device.

Preferably, the first and the second weight form part of, respectively, a first and a second pair of eccentrically rotatable weights, wherein the two weights of each pair rotate in opposite directions, thus producing vibration substantially in one direction. The weights of each pair rotate at the same rotational speed, but in opposite directions, as a result of which said rectilinear vibration is obtained. By having two pairs of weights each produce rectilinear vibration, in both cases in the same direction, the vibration of one pair of weights can amplify or attenuate the vibration of the other pair of weights, depending on the rotational position of one pair of weights relative to the rotational position of the other pair of weights. All this is described in detail in the aforesaid EP-A-0524056.

SUMMARY OF THE INVENTION

Preferably, the three parts of the differential are coaxially rotatable relative to each other, and each of said parts comprises a gear which is in mesh with a gear of another part.

In one preferred embodiment, the first and the second part of the differential are coaxially rotatable conical gears whose teeth extend towards each other, and the third part is a coaxially rotatable carrier which carries one or more radially extending, relative to its axis of rotation, conical gears, wherein each of the latter conical gears is in mesh with both former conical gears. This is a type of differential which is also used in the rear axle of vehicles for driving the two rear wheels thereof.

Preferably, said carrier is fixedly mounted on a coaxial shaft, on which shaft said two former conical gears are mounted in a manner which allows coaxial rotation, and wherein the phase shift can be adjusted by rotation of the central coaxial shaft. This makes it possible to control the phase shift in an simple, mechanical manner.

In another preferred embodiment, said carrier is rotatably mounted on said central, coaxial shaft, and the carrier is fixed in the desired position by fixing means which are disposed outside the carrier, seen in radial direction. Said fixation may for example be carried out by moving a radially extending handle which is mounted on the carrier.

In the device according to the aforesaid EP-A-0524056, the two gears of the phase shifter rotate in the same direction. In the above-described device, the two gears of the phase shifter rotate in opposite directions. This does not complicate matters as regards the drive of the two pairs of eccentric wheels, since the direction in which the eccentrically rotatable wheels rotate has no influence on the generation of the rectilinear vibration.

In another preferred embodiment, the differential comprises planetary gearing comprising a sun gear, a satellite carrier and a planet gear, which are coaxially rotatable relative to each other. The advantage of a differential of this kind is that it has a limited dimension in axial direction. One drawback of such a planetary differential is the fact that when one of the parts is kept stationary, the two other parts will always rotate at different rotational speeds. When the two gears of the phase shifter have different diameters, however, this difference in rotational speed can be compensated in such a manner that the two gears rotate at the same peripheral velocity.

Preferably, the first part of the differential is the sun gear, the second part is the satellite carrier and the third part is the planet gear. The planet gear can be engaged from outside thereby so as to keep it in a stationary position, whilst one of the two gears of the phase shifter can be fixed on the central, coaxial shaft together with the sun gear.

In another preferred embodiment, the first part of the differential is the planet gear, the second part is the satellite carrier and the third part is the sun gear, which sun gear is fixedly mounted on the coaxial shaft, about which shaft the satellite carrier and the planet gear can rotate. The phase shift or the weights can thereby take place by rotation of the central shaft, in the same manner as described before.

The invention furthermore relates to a method for driving an object by vibration, in particular a pile or sheet piling to be driven into the ground, wherein a first eccentric weight and a second eccentric weight are rotated, wherein the rotational positions of the weights are adjusted relative to each other by means of a phase shifter, wherein said phase shifter comprises a differential which is provided with three interconnected, rotatable parts, wherein rotation of one part results in rotation of another part or of both other parts, and wherein said rotational position is adjusted by rotating part of said differential, whilst each of the other two parts is in drivable contact with an eccentric weight.

Further aspects, which can be used separately as well as in combination with each other, are described by means of two embodiments and defined in the claims.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

In order to explain the invention more fully, two embodiments of a device for putting objects into the ground by vibration will now be described with reference to the drawings.

The figures are merely schematic representations, wherein corresponding parts are indicated by the same numerals.

DETAILED DESCRIPTION OF THE PREFERRED EMBODIMENT

Figure 1:
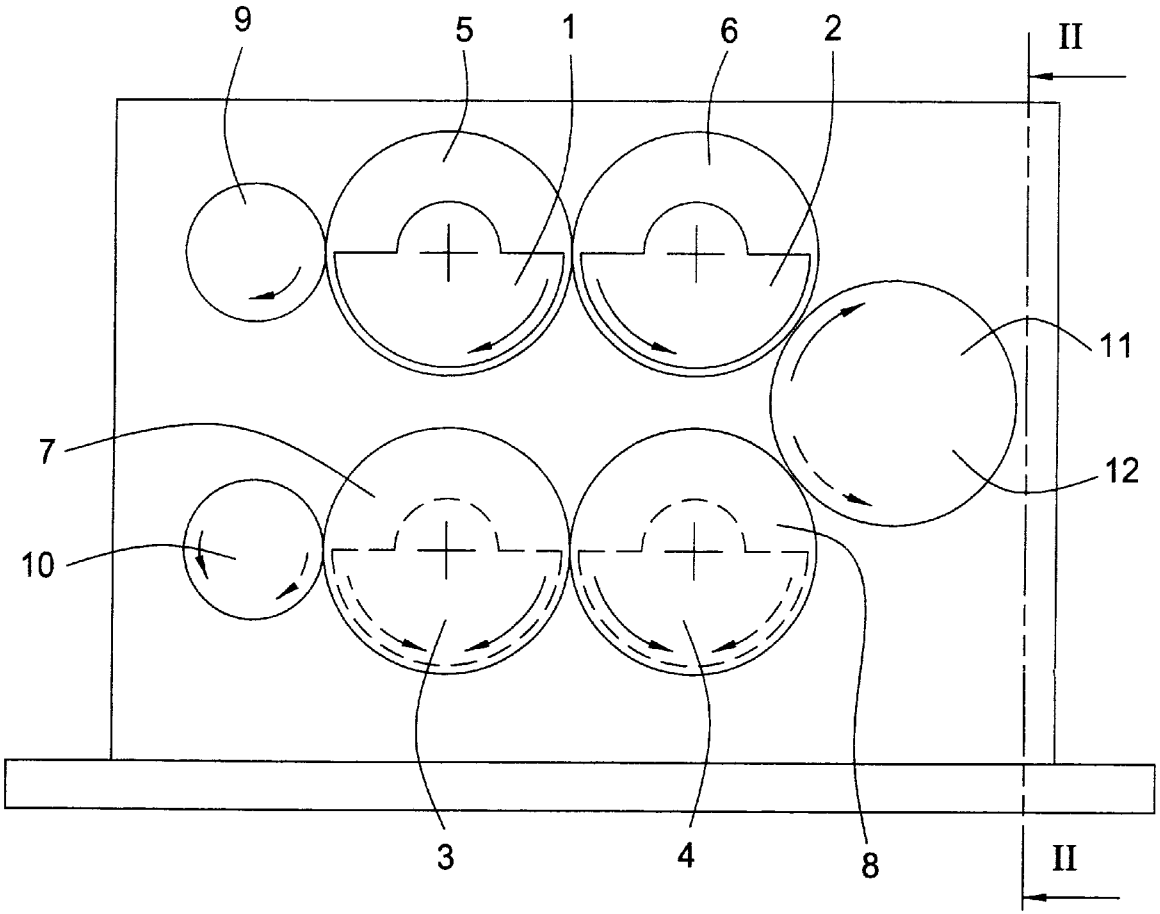
FIG. 1 is a schematic side view of the device.

FIG. 1 shows a first pair of eccentrically rotatable weights 1, 2, as well as a second pair of eccentrically rotatable weights 3, 4. Each of said eccentric weights 1, 2, 3, 4 is mounted on a gear 5, 6, 7, 8, wherein the gears 5, 6, 7, 8 of each pair of weights are in mesh with each other. The weights 1, 2; 3, 4 of each pair rotate in opposite directions relative to each other, therefore, as is indicated by means of the arrows.

FIG. 1 shows two hydraulic motors 9, 10 for driving the eccentric weights; which motors are each in mesh with a gear 5, 7 of an eccentric weight 1, 3. Gears 6, 8 of eccentric weights 2, 4 are each in mesh with a gear 11, 12 of a phase shifter, which gears coincide in the view according to FIG. 1.

It will be apparent that when gears 11, 12 of the phase shifter are fixedly interconnected, the two hydraulic motors 9, 10 will rotate the eccentric weights 1, 2, 3, 4 in such a manner that the device is caused to vibrate rectilinearly in vertical direction, that is, from top to bottom in FIG. 1. In the illustrated position of the eccentric weights, the resulting vibration will be the sum of the vibration of each of the pairs of eccentric weights, at least when the rotational speed of all weights is equal. By changing the rotational position of weights 1, 2 of the first pair relative to the rotational position of the weights 3, 4 of the second pair, the vibration being imposed on the device will be attenuated, whereby there will no longer be resulting vibration once the rotational position of one of the pairs of eccentric weights has been turned through 180° in comparison with the situation as shown in FIG. 1.

The changing of the rotational position, or the shifting of the phase of the vibration of one of the pairs of eccentric weights relative to the other pair is effected by a phase shifter 13, which changes the rotational position of the two gears 11 and 12 relative to each other.

Figure 2:
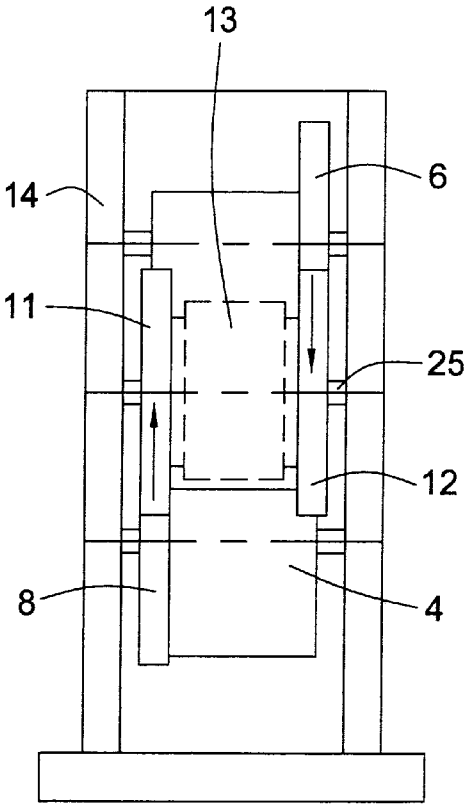
FIG. 2 is a sectional view along line II—II in FIG. 1.

FIG. 2 is a sectional view of the device, wherein the phase shifter 13 comprising the two gears 11, 12 to be moved relative to each other is schematically indicated by means of a chain-dotted line. The whole is present within a housing 14, which housing can be fixed to an object which is to be vibrated.

FIGS. 1 and 2 show a device as known from EP-A-0524056, wherein the two gears 11, 12 of phase shifter 13 have the same diameter and rotate in the same a direction. This is not the case in the three illustrated embodiments of the invention. In the first and the third embodiments (FIGS. 3 and FIGS. 5, 6, respectively) the two gears 11, 12 of phase shifter 13 rotate in opposite directions, so that a situation is obtained wherein gears 7, 8, 12 rotate in the direction which is indicated in FIGS. 1, 2 by an arrow illustrated in chain-dotted lines. This other direction of rotation has no consequences as regards the vibrating effect of the device, however.

In the second embodiment of the invention (FIG. 4), the rotational speed of gear 11 is not the same as the rotational speed of gear 12 of the phase shifter, which is compensated by using gears 11, 12 having different diameters, so that the peripheral velocity of said gears 11, 12 will be the same for both gears. As a result of, the position of phase shifter 13 will slightly differ from the position as shown in FIGS. 1 and 2, so that the gears 11, 12 having different diameters will correctly mesh with gears 6, 8 of the pairs of weights.

Figure 3:
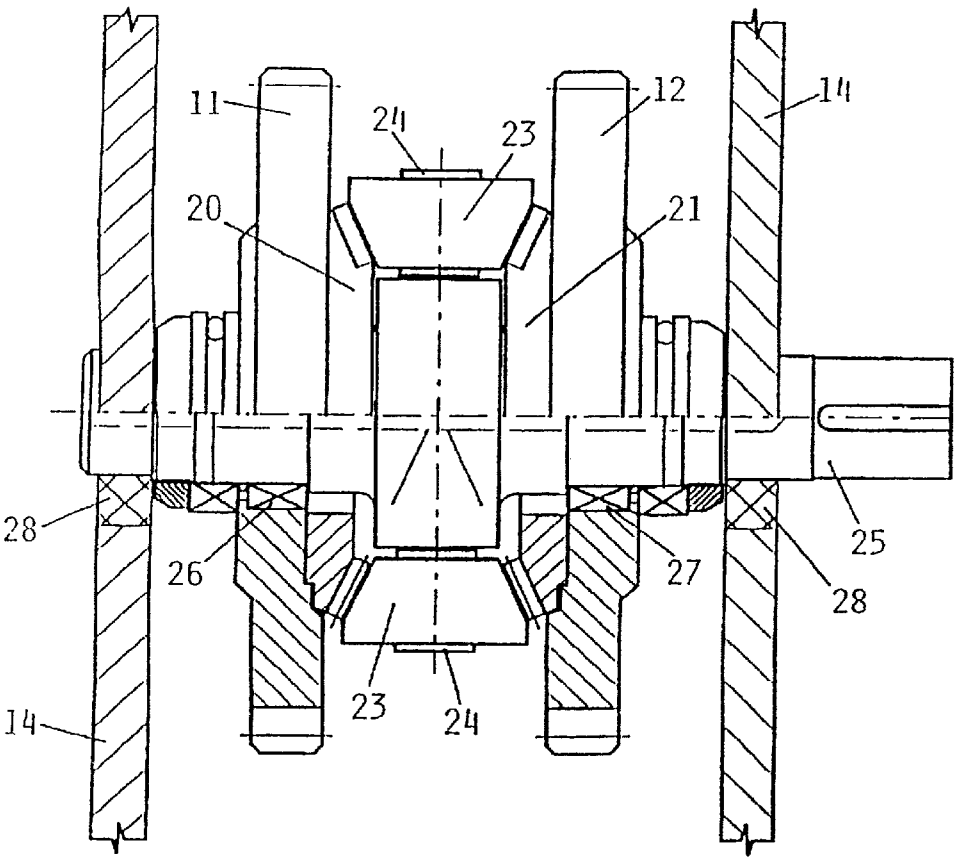
FIG. 3 shows a first embodiment.

FIG. 3 schematically shows a phase shifter which is provided with a differential comprising three parts which rotate relative to each other, a first part provided with a conical gear 20, which is fixed to gear 11, a second part provided with a conical gear 21 fixed to gear 12, and a third part consisting of a number of conical gears 23, which are in mesh with the aforesaid two conical gears 20, 21, which conical gears 23 are rotatable about shafts 24, which extend perpendicularly to the shaft 25 about which the three parts of the differential can rotate.

In the embodiment of FIG. 3, conical gear 20 is rotatably mounted on shaft 25, together with gear 11, by means of a bearing 26, and gears 12, 21 are jointly and rotatably mounted on the same shaft 25 by means of bearing 27. Conical gears 23 are freely rotatable on shaft 24, which shaft is fixedly mounted on shaft 25.

It will be apparent that when shaft 25 is kept in a fixed position, gears 11, 20 on the one hand and gears 12, 21 on the other hand will rotate at the same speed, albeit in opposite directions, at all times. By means of this phase shifter, the weights 1, 2 which are shown in FIG. 1 will rotate as indicated by the arrows, and weights 3, 4 and hydraulic motor 10, as well as gear 11 in FIG. 1, will rotate in the direction indicated by the arrows which are illustrated in dash lines.

According to FIG. 3, shaft 25 is rotatably mounted in housing 14 of the device by means of bearings 28. Rotation of shaft 25, and thus of shafts 24 of conical gears 23, will effect a change of the phase of the vibration produced by first pair of weights 1, 2 relative to the vibration produced by the second pair of weights 3, 4. The intensity of the vibration of the device can therefore be controlled by rotating shaft 25, which rotation can take place from a location outside housing 14, for example by fitting shaft 25 with a gear which can be rotated through a particular angle.

It is also possible to effect a change in the rotational position of shafts 24 with the conical gears 23 in a different manner. Thus, said shafts can be mounted on shafts 25 via a bearing, wherein one of the shafts 24 is lengthened, so that said shaft 24 can be held in position at a particular location. The rotational position 24 and thus the phase shift can be controlled by changing the location of said shaft 24.

Figure 4:
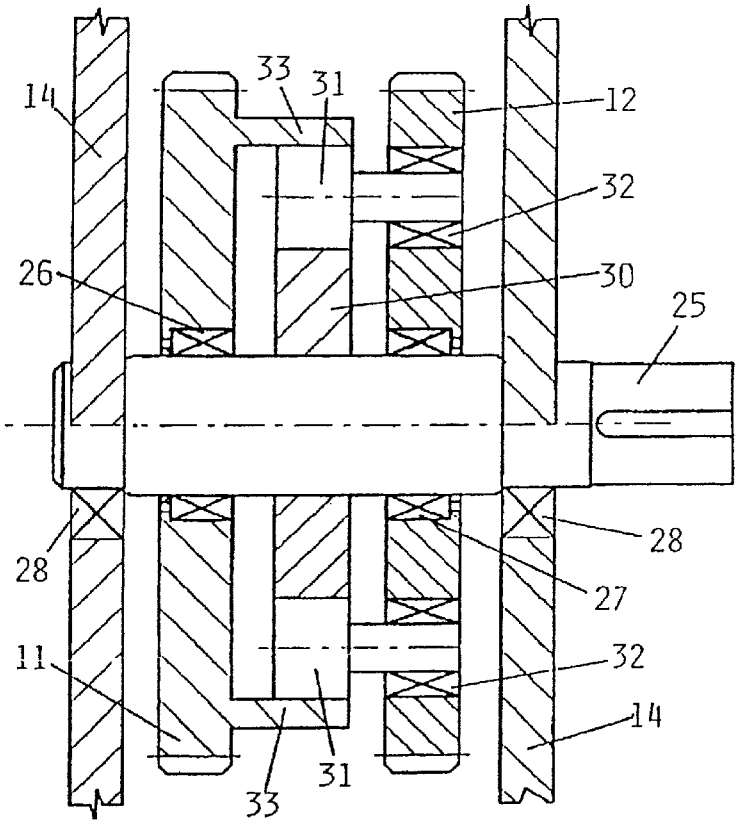
FIG. 4 shows a second embodiment.

FIG. 4 shows a second embodiment, wherein the phase shifter is provided with a differential comprising planetary gearing. The central shaft 25 in this embodiment is likewise rotatably mounted in housing 14 by means of bearings 28. Mounted on said central shaft 25 is the sun gear 30 of the planetary gearing. Sun gear 30 is in mesh with a number of satellite gears 31, which are rotatably supported in gear 12 by means of bearings 32. Gear 12 is rotatably mounted on shaft 25 by means of bearings 27.

Gears 31 are on the other hand in mesh with planet gear 33 of the planetary gearing, which planet gear 33 is mounted on gear 11. Gear 11 is rotatably mounted on shaft 25 by means of bearings 26.

It will be apparent that when shaft 25 carrying gear 30 is kept in a stationary position, and gear 12, which forms the satellite carrier of the planetary gearing, is rotated, planet gear 33 and gear 11 will rotate in the same direction, albeit at greater speed. The diameters of the gears 11 and 12 have been so selected that the gears 11, 12 will rotate at the same peripheral velocity when shaft 25 is kept stationary. As a result, they will interconnect the pairs of weights 1, 2; 3, 4 in such a manner that all weights will rotate at the same speed. It is possible thereby to effect a phase shift of the vibration which is produced by the first pair of weights 1, 2 relative to the vibration which is produced by the second pair of weights 3, 4 by rotating shaft 25 through a particular angle.

Figure 6:
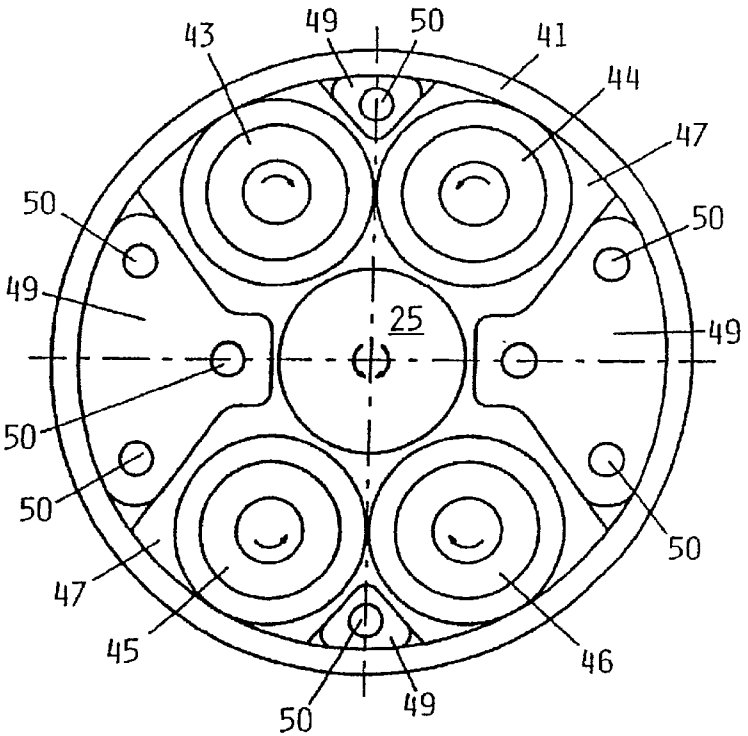
FIGS. 5 and 6 shows a third embodiment.
Figure 5:
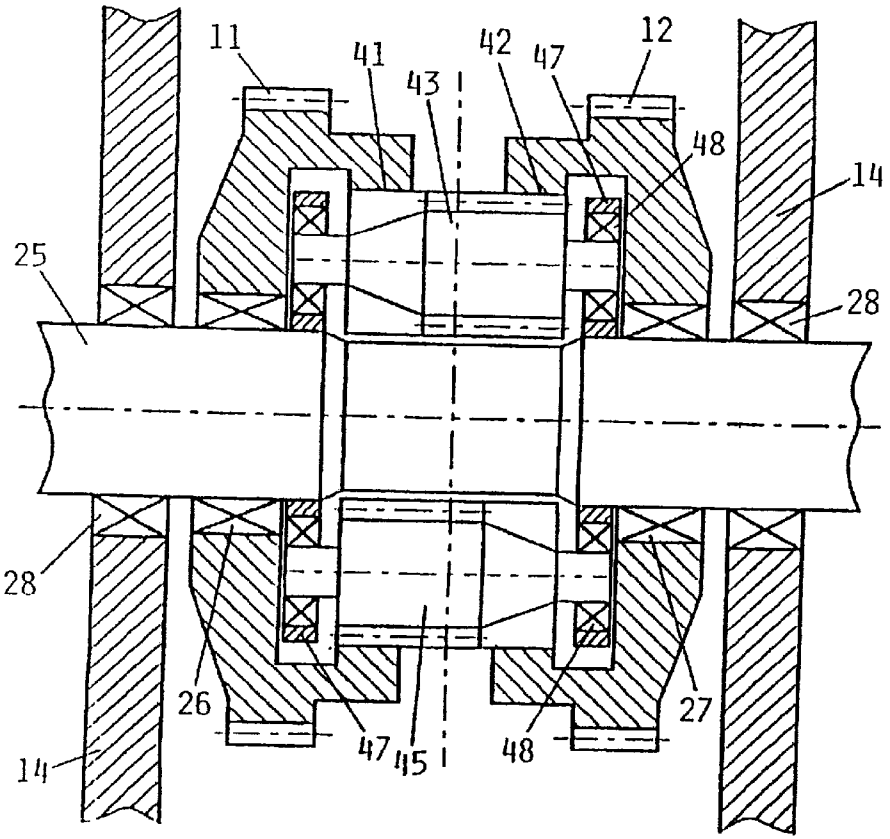

FIGS. 5 and 6 show a third embodiment of the phase shifter 13. Also in this embodiment a central shaft 25 is supported in a housing 14 by means of bearings 28. A carrier 47 is fixedly mounted on central shaft 25, which carrier comprises two disc-shaped plates, between which gears 43, 44, 45, 46 are mounted, which gears are supported in said two plates by means of bearings 48. FIG. 6 schematically illustrates carrier 47 and shows that gears 43, 44 as well as gears 45, 46 are in mesh with each other, which enables them to rotate in the direction indicated by the arrows.

According to FIG. 6, carrier 47 is furthermore provided with connecting elements 49, which are secured to both plates by means of bolts 50.

In FIG. 5 gears 43 and 45 are shown for the sake of clarity, in reality, however, said gears are not disposed opposite each other (see FIG. 6).

Gears 43, 44, 45, 46 are satellite gears, which are surrounded by two planet gears, namely the internal gears 41, 42, which are rotatably supported on shaft 25 by means of bearings 26, 27. Internal gear 41 is in mesh with gears 44 and 45 and internal gear 42 is in mesh with gears 42 and 46. It will be apparent that when carrier 47 is kept stationary, internal gears 41 and 42 will rotate at the same speed in opposite directions. Since gears 11 and 12 are integrally connected to internal gears 41 and 42, respectively, gears 11 and 12 will likewise rotate at the same speed in opposite directions when carrier 47, or shaft 25, is kept stationary.

By rotating central shaft 25 through a particular angle, a difference in speed between gears 11 and 12 is created temporarily, so that a phase shift will take place.

In the above embodiments, the angular position of shaft 25 thus determines the relative rotational position of the pairs of eccentrically rotatable weights 1, 2, 3, 4, as a result of which the desired intensity of vibration of the device can be adjusted by changing the angular position of the device.

It will be apparent that one motor 9, 10 (FIG. 1) already suffices for driving the device. FIG. 1, however, shows an embodiment comprising two hydraulic motors, which increases the power of the device. If only one hydraulic motor 9, 10 is present, the phase shifter 13 not only functions to arrange the relative rotational position of the pairs of weights, but also to fully drive one of the two pairs of eccentric weights 1, 2; 3, 4. The phase shifter 13 is loaded less heavily, therefore, when two hydraulic motors 9, 10 are used.

While the foregoing is directed to embodiments of the present invention, other and further embodiments of the invention may be devised without departing from the basic scope thereof, and the scope thereof is determined by the claims that follow.

What is claimed is:

1. A device for driving an object by vibration, into the ground or be removed therefrom, which device comprises a first eccentrically rotatable weight and a second eccentrically rotatable weight, which weights are interconnected by a phase shifter which is capable of adjusting the rotational position of the weights relative to each other, characterized in that the device is provided with a phase shifter comprising a differential which is provided with three interconnected, rotatable parts, wherein rotation of one part results in rotation of another part or of both other parts, the first part of which differential is in drivable contact with the first rotatable weight, and the second part of which is in drivable contact with the second rotatable weight, and wherein the rotational position of the third part determines the relative rotational position of the two rotatable weights;

wherein the first part of the differential is a planet gear, the second part is a satellite carrier and the third part is a sun gear, which sun gear is fixedly mounted on a coaxial shaft, about which shaft said carrier and said planet gear can rotate; and wherein the first and the second weight form part of, respectively, a first and a second part of eccentrically rotatable weights and the two weights of each part rotate in opposite directions, thus producing vibration substantially in one direction.

2. A device for driving an object by vibration, into the ground or be removed therefrom, which device comprises a first eccentrically rotatable weight and a second eccentrically rotatable weight, which weights are interconnected by a phase shifter which is capable of adjusting the rotational position of the weights relative to each other, characterized in that the device is provided with a phase shifter comprising a differential which is provided with three interconnected, rotatable parts, wherein rotation of one part results in rotation of another part or of both other parts, the first part of which differential is in drivable contact with the first rotatable weight, and the second part of which is in drivable contact with the second rotatable weight, and wherein the rotational position of the third part determines the relative rotational position of the two rotatable weights;

wherein the first and the second part of said differential each comprise a planet gear which is in mesh with a satellite gear, wherein satellite gears are in mesh with each other and a remounted on a carrier which is fixedly mounted on a central shaft and which forms part of the third part of the differential; and wherein the first and the second weight form part of, respectively, a first and a second part of eccentrically rotatable weights and the two weights of each part rotate in opposite directions, thus producing vibration substantially in one direction.

3. A device for driving an object by vibration, into the ground or be removed therefrom, which device comprises a first eccentrically rotatable weight and a second eccentrically rotatable weight, which weights are interconnected by a phase shifter which is capable of adjusting the rotational position of the weights relative to each other, characterized in that the device is provided with a phase shifter comprising a differential which is provided with three interconnected, rotatable parts, wherein rotation of one part results in rotation of another part or of both other parts, the first part of which differential is in drivable contact with the first rotatable weight, and the second part of which is in drivable contact with the second rotatable weight, and wherein the rotational position of the third part determines the relative rotational position of the two rotatable weights;

wherein the first and the second part of the differential are coaxially rotatable conical gears whose teeth extend towards each other, and the third part is a coaxially rotatable carrier which carries one or more radially extending, relative to its axis of rotation, conical gears wherein each of the latter conical gears is in mesh with both former conical gears;

wherein said carrier is fixedly mounted on a coaxial shaft, on which shaft said two former conical gears are mounted in a manner which allows coaxial rotation, and wherein the phase shift can be adjusted by rotation of the central coaxial shaft.

4. A device for driving an object by vibration, into the ground or be removed therefrom, which device comprises a first eccentrically rotatable weight and a second eccentrically rotatable weight, which weights are interconnected by a phase shifter which is capable of adjusting the rotational position of the weights relative to each other, characterized in that the device is provided with a phase shifter comprising a differential which is provided with three interconnected, rotatable parts, wherein rotation of one part results in rotation of another part or of both other parts, the first part of which differential is in drivable contact with the first rotatable weight, and the second part of which is in drivable contact with the second rotatable weight, and wherein the rotational position of the third part determines the relative rotational position of the two rotatable weights;

wherein said differential comprises planetary gearing having a satellite carrier and a planet gear, which are coaxially rotatable relative to each other, wherein the first part of the differential is the planet gear, the second part is the satellite carrier and the third part is a sun gear, which sun gear is fixedly mounted on a coaxial shaft, about which shaft said carrier and said planet gear can rotate.

5. The device of claim 1, wherein the planet gear and the satellite carrier have different diameters.

6. The device of claim 1, wherein the planet gear and the satellite carrier rotate at different speeds.

7. A device for driving an object by vibration, into the ground or be removed therefrom, which device comprises a first eccentrically rotatable weight and a second eccentrically rotatable weight, which weights are interconnected by a phase shifter which is capable of adjusting the rotational position of the weights relative to each other, characterized in that the device is provided with a phase shifter comprising a differential which is provided with three interconnected, rotatable parts, wherein rotation of one part results in rotation of another part or of both other parts, the first part of which differential is in drivable contact with the first rotatable weight, and the second part of which is in drivable contact with the second rotatable weight, and wherein the rotational position of the third part determines the relative rotational position of the two rotatable weights and that the three parts of the differential are coaxially rotatable relative to each other.

8. A device for driving an object into the ground by vibration, or removing it therefrom, which device comprises a first pair of eccentrically rotatable weights and a second pair of eccentrically rotatable weights, wherein two weights of each pair rotate in opposite directions, thus producing vibration substantially in one direction, which pairs of weights are interconnected by a phase shifter which is capable of adjusting the rotational position of the pairs of weights relative to each other, which phase shifter comprises a differential which is provided with three interconnected, rotatable parts, wherein rotation of one part results in rotation of another part or of both other parts, the first part of which differential is in drivable contact with the first rotatable pair of weights, and the second part of which is in drivable contact with the second rotatable pair of weights, wherein the rotational position of the third part determines the relative rotational position of the two rotatable pairs of weights, wherein the first and the second part of the differential are coaxially rotatable conical gears whose teeth extend towards each other, and the third part is a coaxially rotatable carrier which carries one or more radially extending, relative to its axis of rotation, conical gears, and wherein each of the latter conical gears is in mesh with both former conical gears.

9. A device according to claim 8, wherein said carrier is fixedly mounted on a coaxial shaft, on which shaft said two former conical gears are mounted in a manner which allows coaxial rotation, and wherein the phase shift can be adjusted by rotation of the central coaxial shaft.

10. A device according to claim 9, wherein said carrier is rotatable about a coaxial shaft, about which at least one of said former conical gears is rotatable, and in that means are present for controlling the angular displacement of the carrier.

* * * * *